United States Patent [19]

Hanyu et al.

[11] Patent Number: 5,022,335

[45] Date of Patent: Jun. 11, 1991

[54] UPPER THREAD SUPPLYING DEVICE IN SEWING MACHINE

[75] Inventors: Susumu Hanyu; Noboru Kasuga; Mikio Koike; Kazumasa Hara; Mitsuru Nishijima; Akiyoshi Sasano, all of Tokyo, Japan

[73] Assignee: Janome Sewing Machine Industry Co., Ltd., Tokyo, Japan

[21] Appl. No.: 427,292

[22] Filed: Oct. 26, 1989

[30] Foreign Application Priority Data

Oct. 28, 1988 [JP] Japan ..... 63-270789

[51] Int. Cl.[5] ..... D05B 47/04

[52] U.S. Cl. ..... 112/255; 112/302; 112/453; 112/262.1

[58] Field of Search ..... 112/302, 255, 254, 241, 112/453, 273, 278, 97, 59, 242, 242, 262.1

[56] References Cited

U.S. PATENT DOCUMENTS 4,566,396 1/1986 Sakuma et al. ..... 112/302
4,702,185 10/1987 Hanyu et al. ..... 112/453 X
4,791,876 12/1988 Sasaki et al. ..... 112/302 X
4,932,346 6/1990 Matsubara et al. ..... 112/302 X

FOREIGN PATENT DOCUMENTS 59-40896 3/1984 Japan ..... 112/302

*Primary Examiner*—Peter Nerbun
*Attorney, Agent, or Firm*—Dann, Dorfman, Herrell and Skillman

[57] ABSTRACT

An upper thread carried by a vertically reciprocating needle is drawn from a bobbin through a tensioning device, a supply device and a take-up lever. A predetermined amount of the upper thread is first supplied by actuating the supply device, while applying no tension thereto. An additional amount of the upper thread is then supplied by operation of the take-up lever with a predetermined tension being given thereto. The additional amount is detected by a sensor. The supply device includes a one-way clutch for allowing the upper thread to travel in a predetermined direction which, however, may not be conveyed from the needle side when the supply device is made operative. A CPU controls the amount of thread first supplied by the supply device which will always be smaller than an amount actually required for producing a stitch, resulting in an additional amount to be supplied supplemental in cooperation with the tensioning device.

6 Claims, 8 Drawing Sheets

UPPER THREAD SUPPLYING DEVICE IN SEWING MACHINE

BACKGROUND OF THE INVENTION

1. Filed of the Invention

This invention relates to a sewing machine in general and more particularly to an upper thread supplying device employed in the sewing machine, especially an electronically controlled sewing machine.

2. Description of the Prior Art

In a sewing machine operation, an upper thread is drawn out of a bobbin mounted in a machine housing to be supplied to a stitching needle. There has recently been provided means for supplying the upper thread, which is actuated in synchronism with reciprocation of the needle to draw a specific amount of the upper thread for producing a stitch, while the upper thread is not tensioned by an upper thread take-up lever. The stitching conditions including a fabric feeding amount, a needle amplitude and a fabric thickness will be inputted to a control unit or CPU, mounted in the machine housing, for theoretically determining an amount of the upper thread required for producing the stitch in accordance with a prescribed program. Such stitching conditions are selected by manipulation of select keys or detected by sensor means before or during the stitching operation.

However, it is often the case that the upper thread amount thus theoretically determined is not coincident with an amount actually required for producing the stitch. Such discrepancy would be caused by other stitching conditions not included in the data to be inputted to CPU for determining the theoretical amount. For example, a friction coefficient of a fabric to be sewn with respect to fabric feeding means or a feed dog will have an influence on fabric feeding efficiency. Should the fabric be made of a slippery material having a small friction coefficient, there would be a discrepancy between the theoretically determined amount and the actually required amount. The fabric thickness would be changed with a pressure applied to the fabric by means of a presser foot. A sliding resistance of the fabric and/or thread employed and expansion of the thread would also be fluctuation factors. These stitching conditions would be difficult to be processed into data and therefore have not been considered in determination of the upper thread amount to be supplied for producing the stitch. Consequently, even if the upper thread amount should be theoretically determined by conventionally inputted data regarding the stitching condition typically including the fabric feeding amount, the needle amplitude and the fabric thickness, there would arise an excessive supply or a shortage of the upper thread due to other stitching conditions not inputted as fluctuation data to CPU, resulting in deformation of the stitch formed on the fabric.

SUMMARY OF THE INVENTION

It is therefore an object of this invention to provide a novel device for supplying an upper thread in a sewing machine capable of eliminating disadvantages of the prior art stitching operation.

Another object of this invention is to provide means for compensating a discrepancy between an amount of an upper thread to be required for producing a stitch which is theoretically determined in dependence upon typical stitching conditions and another amount of the upper thread which is required for actually producing the stitch.

According to an aspect of this invention there is provided an upper thread supplying device used in combination with a sewing machine having an upper thread supply source, a vertically reciprocating needle carrying an upper thread supplied from the upper thread supply source, loop taker means cooperating with the needle to form a stitch by interlocking the upper thread with a lower thread carried by the loop taker means and upper thread take-up lever operated in synchronism with reciprocation of the needle, which comprises: tension applying means for applying a tension to the upper thread, arranged between the upper thread supply source and the upper thread take-up lever and operated intermittently in synchronism with reciprocation of the needle; upper thread supplying means for drawing the upper thread out of the upper thread supply source when the tension applying means is not operative; operating means for determining a theoretical amount of the upper thread which is required for forming a desired stitch on a theoretical basis with stitch condition data inputted thereto, and also for determining a practical amount of the upper thread by deducting a specific amount from the theoretical amount, the practical amount of the upper thread being outputted therefrom; and control means operated in response to the output from the operating means for actuating the upper thread supplying means, thereby supplying the practical amount of the upper thread. An additional amount of the upper thread, which is a difference between the practical amount supplied by the upper thread supply means and an amount actually required for completing the stitch, is supplied from the upper thread supply source through the tension applying device which is now made operative to apply a predetermined tension to the upper thread, during ascent of the upper thread take-up lever.

In accordance with another aspect of the invention there is provided a process for supplying an upper thread from an upper thread bobbin to a vertically reciprocating needle in formation of a stitch with a sewing machine, comprising the steps of supplying a predetermined amount of the upper thread while applying no tension thereto, the predetermined amount being determined to be smaller than an amount considered to be theoretically required for producing a stitch; and then supplying an additional amount of the upper thread while applying a predetermined tension thereto, the additional amount being a difference between the predetermined amount and an amount actually required for producing the stitch. The two-stage upper thread supplying steps will be controlled in synchronism with reciprocation of the needle.

BRIEF DESCRIPTION OF THE DRAWINGS

Further objects and advantages of this invention can be fully understood from the following detailed description when read in conjunction with the accompanying drawings in which.

DETAILED DESCRIPTION OF THE EMBODIMENT

Figure 1:
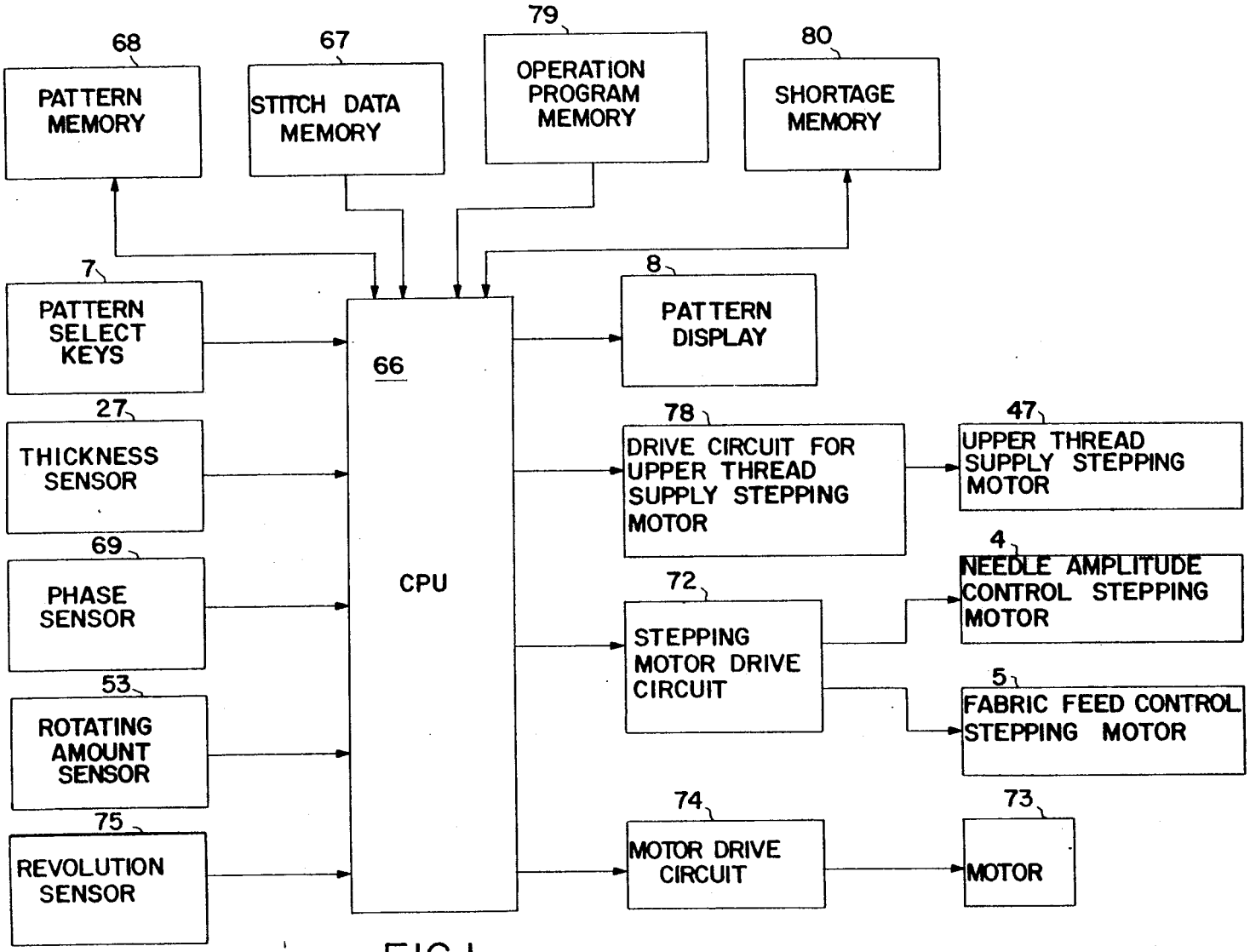
FIG. 1 is a block diagram of control operation performed by an electronic sewing machine embodying the invention.
Figure 2:
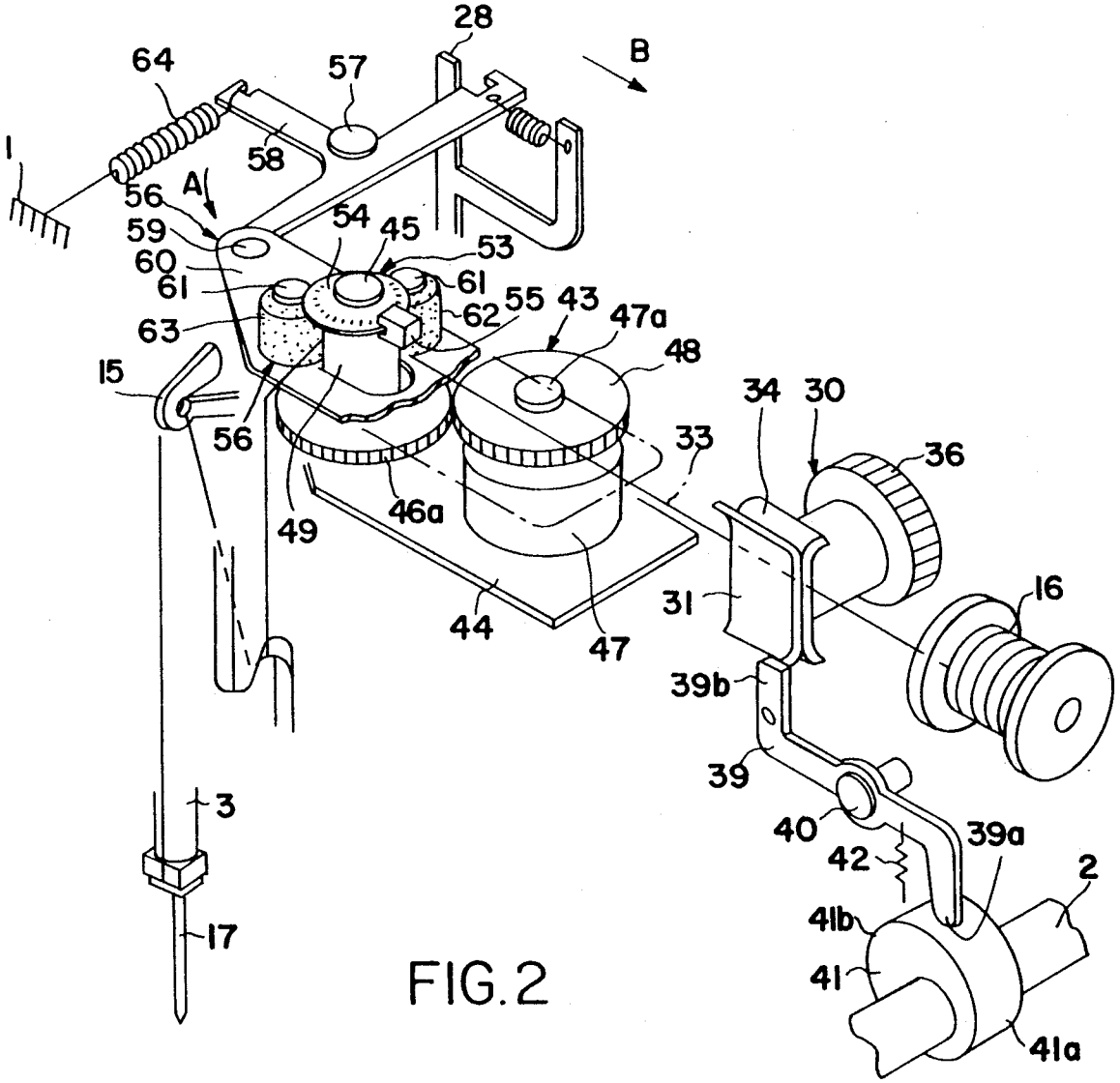
FIG. 2 is a perspective view showing principal parts of the sewing machine.
Figure 3:
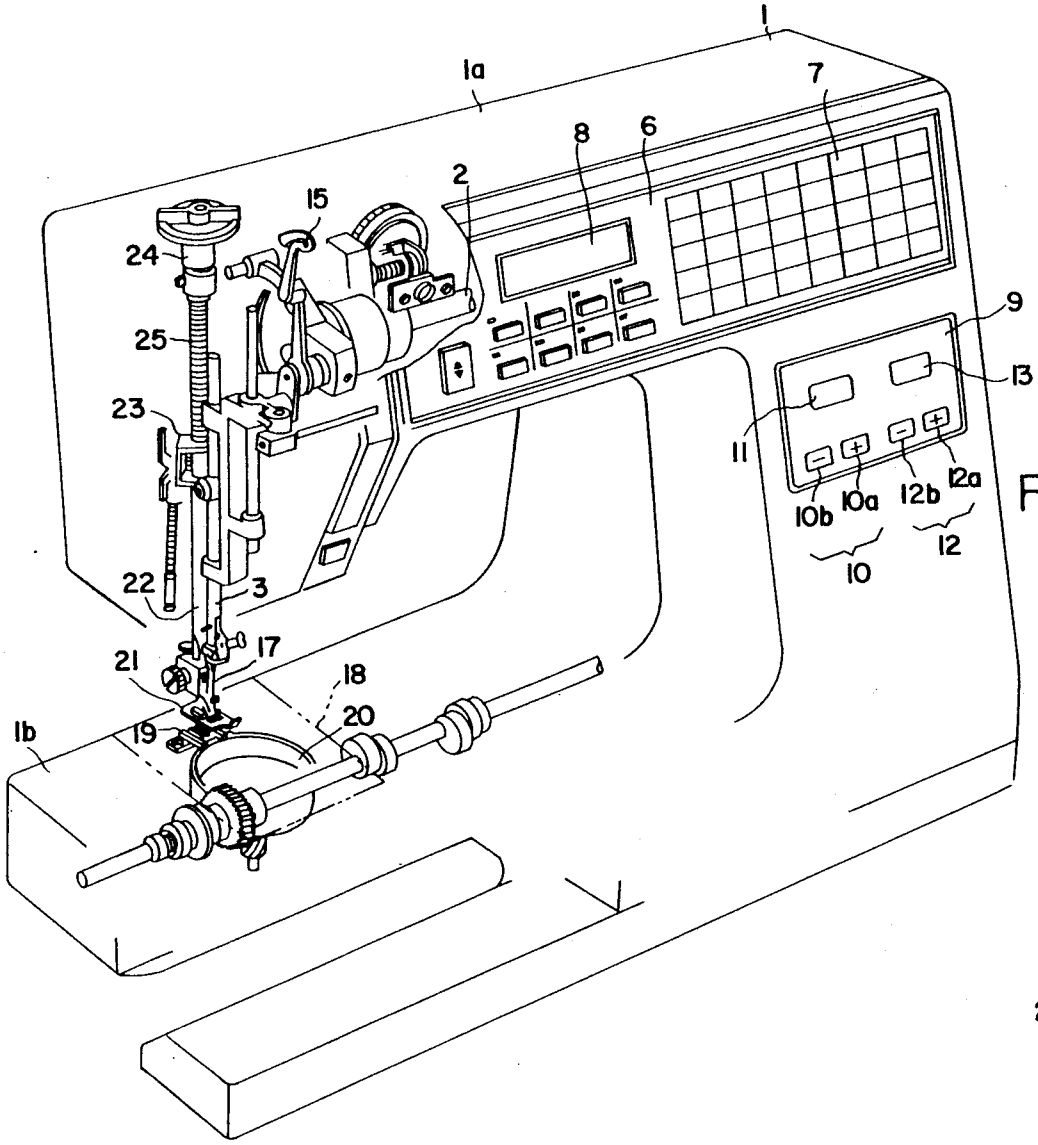
FIG. 3 is a perspective view showing the sewing machine.

Referreing specifically to FIG. 2 and FIG. 3, general appearance and construction of an electronic sewing machine embodying the invention will be described. A main drive shaft 2 is rotatably supported within an arm section 1*a* of a machine housing 1 and connected to a drive source or motor (not shown) for rotation therewith. To the other end of the main drive shaft 2 is connected a needle bar 3 which is adapted to reciprocate up and down in synchronism with the main drive shaft 2 and swing in a direction perpendicular to a fabric feeding direction for zigzag sewing operation. The needle bar 3 is provided at the tip end with a needle 17 carrying a needle thread or an upper thread 33 (FIG. 2). The needle bar 3 is connected via a suitable transmission mechanism (not shown) to a stepping motor 4 (FIG. 1) mounted in the machine housing 1 for control of the needle amplitude. The lower part of the machine housing 1 is formed into a bed 1*b* on which a needle plate 18 is secured in opposition to the needle 17. The needle plate 18 includes a needle hole (not shown) for allowing penetration of the needle 17. Also, an elongated groove (not shown) is formed on the needle plate 18 in close vicinity to the needle hole so that a feed dog 19 which is mounted within the bed 1*b* may extend through the groove for feeding a fabric (not shown) in a predetermined direction in cooperation with a presser foot 21 to be described later. A feeding amount of the fabric which is determined by a driving amount of the feed dog 19 will be controlled by another stepping motor 5 (FIG. 1) installed in the machine housing 1 and connected to the feed dog 19. Below the needle plate 18 there is also arranged a loop-taker means 20 which is driven to rotate in synchronism with reciprocation of the needle 17 to form a stitch on the fabric in a known manner.

A plurality of pattern select keys 7 are arranged in a front panel 6 attached to the arm section 1*a*. Upon depression of a selective combination of the pattern select keys 7 to designate a specific pattern number, the said pattern number is represented on an LCD 8. A reference numeral 9 indicates a manual control panel including needle amplitude control means 10 and fabric feeding amount control means 12. These means will be effected when the needle amplitude and/or the fabric feeding amount which will be determined by the stitch control data should be changed upon demand. These control means 10 and 12 comprise respectively an up key 10*a*, 12*a* and a down key 10*b*, 12*b*. The adjusted amount is represented on display 11 or 13.

Figure 7:
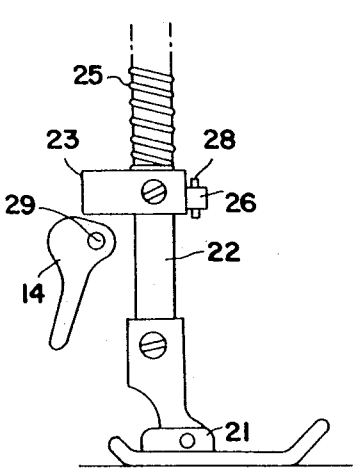
FIG. 6 and FIG. 7 are front and side views showing a fabric thickness sensor.
Figure 6:
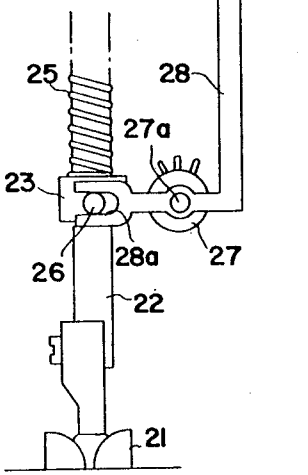

In further reference to FIG. 6 and FIG. 7, the presser foot 21 is detachably mounted to the lower end of a presser bar 22 which is in turn supported to the machine arm 1*a* while allowing elevation with respect thereto. The upper end of the presser bar 22 is connected to a holder 23. A coil spring 25 is depresseed between the holder 23 and a pressure adjusting screw 24 so that a downward directing pressure exerted by the presser foot 21 onto the fabric placed on the needle plate may be adjusted by manipulating the screw 24 from the outside of the machine arm 1*a*. Thus, the fabric is fed by cooperation of the feed dog 19 and the presser foot 21 with a desired degree of pressure. A pin 26 projecting from the holder 23 is engaged between forked branches 28*a* of an L-shaped arm 28 which is secured to a detection shaft 27*a* of a potentiometer 27 fixedly mounted in the machine housing 1, so that the arm 28 may be rotated about the shaft 27*a* in dependence upon a vertical position of the holder 23. A lever 14 is arranged on the machine arm 1*a* for lifting the presser foot 21 to separate from the fabric. When the release lever 14 is actuated to lift the holder 23, the arm 28 is caused to rotate in the clockwise direction as viewed in FIG. 6 to thereby come into engagement with a lever 58 to be described later.

Figure 4:
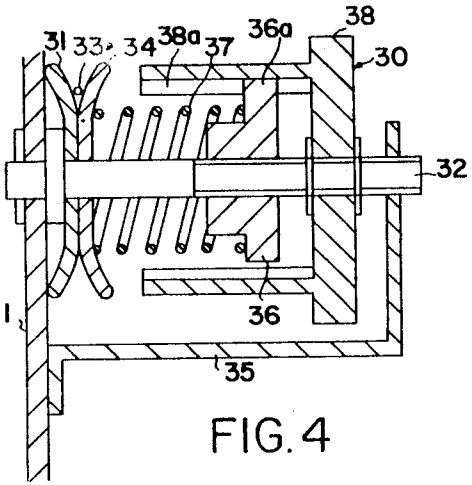
FIG. 4 is an elevational view showing a detailed construction of a tension applying device employed in the sewing machine.

Referring again to FIG. 2, an upper thread take-up lever 15 is connected to the main drive shaft 2 to be actuated in synchronism therewith for drawing the upper thread 33 out of a thread bobbin 16. The upper thread 33 drawn out of the bobbin 16 is given a predetermined degree of tension by a thread tension applying device which is generally referred to by a numeral 30 in FIG. 2 and illustrated in more detail in FIG. 4. In general, the tensioning device 30 comprises a shaft 32 supported to the machine housing 1 via a supporting frame 35, a stationary plate 31 secured to an extreme end of the shaft 32, a slidable plate 34 mounted slidably along the shaft 32 to cooperate with the stationary plate to frictionally interpose the upper thread 33 therebetween, a disc member 36 fixedly engaged into a threaded portion of the shaft 32, a coil spring 37 interposed between the disc 36 and the slidable plate 34 to force the latter toward the stationary plate 31, and a graduated dial 38 rotatably disposed about the shaft 32 and provided with an axially extending groove 38*a* for engagement with a projection 36*a* of the disc 36. Thus, upon rotation of the dial 38, the disc 36 is moved along the shaft 32 to expand or contract the coil spring 37, to thereby adjust friction or tension applied to the upper thread 33 travelling between the plates 31 and 34. The thread tension may be adjusted to a desired degree in reference to the graduations provided on the outer periphery of the adjusting dial 38.

A lever 39 extends along with the upper thread travelling path for releasing the upper thread tension. The tension release lever 39 is pivottable about a pin 40 secured to the machine housing 1, with one end aligned with the contact line between the tension applying plates 31 and 34. The other extreme end of the lever 39 is formed into a nail 39*a* which is adapted to come into contact with a cam 41 secured to the main drive shaft 2. A spring 42 is connected to the lever 39 for achieving constant engagement between the nail 39*a* and the cam 41. When the nail 39*a* is in contact with a large-diameter section 41*b* of the cam 41, the projecting end 39*b* is positioned just below the tension applying plates 31 and 34 without contact thereto. When the main drive shaft 2 rotates half around so that the nail 39*a* comes into contact with a small diameter section 41*a*, the lever 39 is rotated in a clockwise direction as viewed in FIG. 2. As a result, the projecting end 39*b* enters between the plates 31 and 34 so that the slidable plate 34 is wrenched from the stationary plate 31 against the spring 37 to thereby release the tension to be applied to the upper thread 33.

Figure 5:
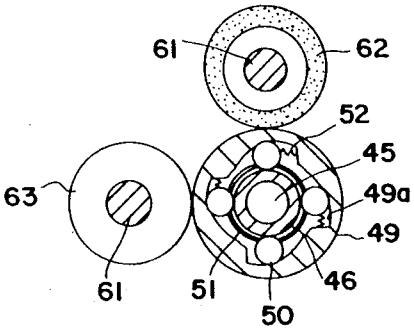
FIG. 5 is an elevational view showing a detailed construction of a one-way clutch.

The upper thread 33 travelling through the tensioning device 33 is then supplied to an upper thread supply device 43 which will now be described in detail in further reference to FIG. 5. A supporting pin 45 extends upward from a base plate 44 secured to the machine housing 1. Around the pin 45 there is rotatably provided a cylinder 45 having at its lower portion an extended gear disc 46*a*. A stepping motor 47 for step-wise drawing of the upper thread 33 is mounted on the base plate 44. To an output shaft 47*a* of the stepping motor 47 is secured to a gear 48 adapted in engagement with the gear disc 46*a*. Around the cylinder 46 there is arranged a drive roller 49 provided at the inner wall with grooves 49*a* for accomodating spherical rolls 50. The respective grooves 49*a* include inclined inner walls so that spacings between the inner walls of the grooves 49*a* and the outer peripheries of the cylinder 46 will vary depending upon relative rotation between the cylinder 46 and the drive roller 49. The rolls 50 are in a lump retained by a connecting ring 51 with a predetermined intervals between two adjacent ones, and have diameter smaller than the largest spacings between the cylinder 46 and the drive roller 49 but larger than the narrowest spacings. Springs 52 are connected between the inner wall of the drive roller 49 and the respective rolls 50 to normally urge the rolls 50 toward the narrower spacings. With such arrangement which will act as a unidirectional clutch, the drive roller 49 may be rotated together with the cylinder 46 when the latter rotates in a counter-clockwise direction, whereas clockwise rotation of the cylinder 46 will not effect rotation of the drive roller 49 because the rolls 50 tend to rotate together with the cylinder 46 to be loosely accomodated within the grooves 52. The latter is also the case where the drive roller 49 is rotated in a counter-clockwise direction while the cylinder 46 remains standstill. An amount of rotation of the drive roller 49 is detected by a sensor 53 comprises a rotary plate 54 secured to the drive roller 49 and provided with a plurality of slits and a photo-interrupter 55.

A one-way supplying mechanism which is generally referred to by a numeral 56 includes a substantially T-shaped lever 58 rotatable about an axis 57 secured to the machine housing 1. The lever 58 will normally be biased to rotate in a counter-clockwise direction as viewed in FIG. 2 due to provision of a spring 64. To one extreme end of the lever 58 is secured a pin 59 which will be a pivot for a platform 60. A pair of pins 61 are supported on the platform 60, around which driven roller 62 and 63 are rotatably fitted respectively. The driven roller 62 positioned upstream is made of elastomeric material effective to supply the upper thread 33 travelling between the rotating roller 49 and the driven roller 62. The second driven roller 63 positioned downstream is, on the contrary, made of the same or similar metallic material to that of the driving roller 49, to conform with sliding friction arising at the time of pulling the upper thread 33 by the take-up lever 15. In the normal position of the lever 58, the platform 60 has been rotated in the direction A so that both of the driven roller 62 and 63 are brought into contact with the driving roller 49. When the release lever 14 (FIG. 7) is actuated to lift the holder 23, the arm 28 is caused to rotate in a direction substantially indicated by an arrow B so that the lever 58 is caused to rotate in a clockwise direction against the spring 64 due to engagement with a free end of the arm 28, to thereby release contact between the driving roller 49 and the driven rollers 62 and 63. The arm 28 may otherwise be constructed as being connected directly to the release lever 14.

Figure 8:
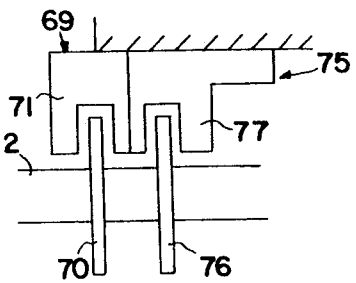
FIG. 8 is an explanatory view showing a main drive shaft phase sensor and a revolution sensor.

A control system employed in the electronic sewing machine will now be described in reference to a block diagram of FIG. 1. There is provided a central processing unit (CPU) 66 to which the aforementioned pattern select keys 7 and the display 8 are connected so that the selected pattern number is represented on the display 8. Stitch control data and pattern number display data for number of stitch patterns selectable by manipulation of the pattern select keys 7 will be stored in a pattern data memory or ROM 67, which may be read out to CPU 66 upon key manipulation. The selected pattern will be temporarily stored in RAM 68. A phase sensor 69 for detecting a rotational phase of the main drive shaft 2, a typical example of which comprises a disc plate 70 secured to the main drive shaft 2 for rotation therewith and formed with a plurality of radially extending slits (not shown) and a photo-interrupter 71, as diagrammatically shown in FIG. 8. The needle amplitude control stepping motor 4 and the fabric feeding amount control stepping motor 5 are driven by a stepping motor drive circuit 72 which is in turn controlled by CPU 66. A driving motor 73 mounted within the machine housing 1 for driving the main drive shaft 2 is driven under control by a motor drive circuit 72 which is in turn controlled by CPU 66. The revolution of the main drive shaft 2, that is an operation speed of the sewing machine, is detected by a speed sensor 75 which typically comprises another disc plate 76 with radial slits (not shown) and another photo-interrupter 77 as diagrammatically shown also in FIG. 8. The upper thread supply control stepping motor 47 is driven under control by a corresponding drive circuit 72 which is in turn controlled by CPU 66. Detection data obtained by the respective sensor means 27, 69, 53 and 75 will be inputted to CPU 66.

There is also provided storage means 79 for storing an operation program for theoretically determining an amount of the upper thread 33 to be supplied, in accordance with the needle amplitude control data and the fabric feed control data, both included in the stitch control data for the selected pattern, and the fabric thickness data detected by an input from the potentiometer 27. Another storage means 80 (a shortage memory) is provided for storing a difference between a first amount of the upper thread drawn by rotation of the drive roller 49 which is detected by the sensor means 53 and a second amount of the upper thread to be drawn in addition.

Figure 9:
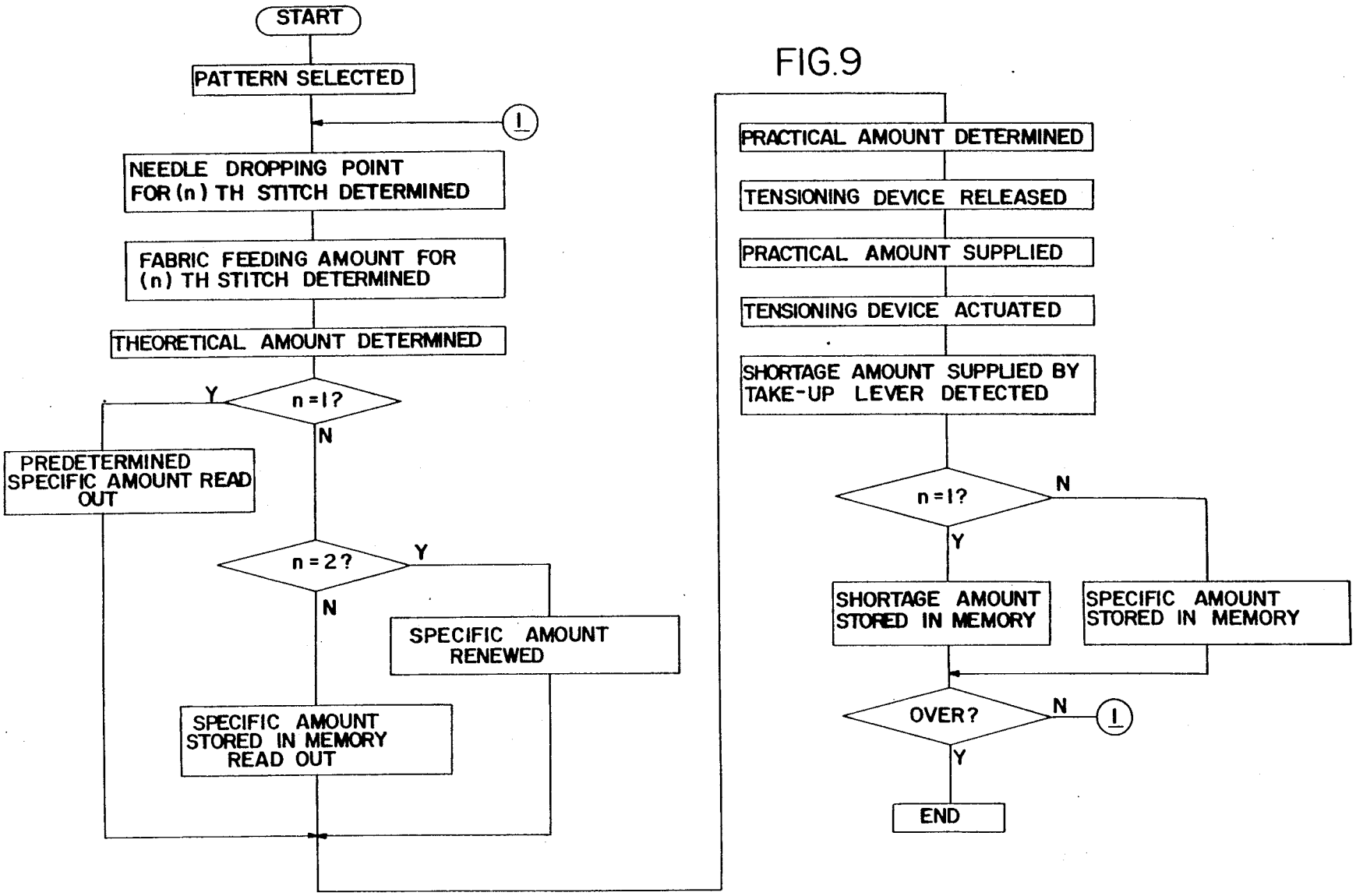
FIG. 9 is a flow chart of an upper thread supplying procedure.

The control system as above constructed will operate as follows. Referring now to FIG. 9, a desired one or combination of the stitch patterns is selected by corresponding manipulation of the pattern select keys 7. The selected pattern is stored in RAM 68. The lift lever 14 is actuated to lift the presser bar 22 and a fabric to be sewn is placed between the needle plate 18 and the lifted presser foot 21. Then, the lever 14 is returned to the original position so that the fabric is interposed therebetween under pressure. Such fabric placement is carried out when the needle 17 is in its upper dead point and the take-up lever 15 has not reached its upper dead point.

The first stitch of the selected pattern is produced in accordance with the stitch control data therefor, which governs operation of the needle amplitude control stepping motor 4 and the fabric feed control stepping motor 5.

The sewing machine motor 73 is now energized by appropriate starting means (not shown) to rotate the main drive shaft 2, whereby the needle 17 starts to descend from its upper dead point. The rotational phase of the main drive shaft 2 will be continuously detected by the sensor 69 to be inputted to CPU 66. When the main drive shaft 2 has reached a specific rotational phase wherein the engaging nail 39*a* comes into contact with the small-diameter portion 41*a* of the cam 41, there will be clockwise rotation of the lever 39 so that the upper thread 33 will be released from interruption caused by the plates 31 and 34, as in a manner described hereinbefore in reference to FIG. 2. Thus, the upper thread 33 may now be drawn out of the bobbin 16 by means of the drive roller 49 during a specific range of the rotational phase of the main drive shaft. The feed dog 19 will be kept hiding under the needle plate 18 during the upper thread releasable phase. By incorporation of the fabric thickness data which has been outputted from the potentiometer 27 into the needle amplitude control data and the fabric feed control data both included in the stitch control data for the selected pattern which have been read out from the stitch data memory 67, a theoretical amount of the upper thread to be drawn out of the bobbin 16 is determined at CPU 66 in accordance with the prescribed program stored in the operation program memory 79. In case of the first stitch, a specific amount S which has been determined on an experimental basis is deducted from the theoretical amount to determine a practical amount of the upper thread to be supplied for producing the first stitch. In accordance with the practical amount thus determined, the stepping motor 47 is driven under control to rotate the gear 48 in a clockwise direction, and thereby to rotate the cylinder 46 in a counter-clockwise direction due to engagement of the gear 48 and 46*a*. The drive roller 49 is rotated together with the cylinder 46 so that the practical amount of the upper thread 33 is drawn out of the bobbin 16 while being interposed between the drive roller 49 and driven rollers 62 and 63, respectively.

After completing the upper thread supplying procedure, the main drive shaft reaches to a rotational phase which causes the nail 39*a* to come into contact with the large-diameter portion 41*b* and therefore the projecting end 39*b* to separate from the tensioning device 30, resulting in the upper thread 33 being resiliently interposed between the plates 31 and 34. Since the practical amount, that is an amount of the upper thread 33 to be actually supplied during the upper thread supply phase is somewhat shorter than the theoretical amount, there will be a shortage of the upper thread carried by the needle for actually producing the stitch. Such a shortage will be made good when the take-up lever 15 is lifted to pull a corresponding amount of the upper thread out of the bobbin 16, which will pass through the tensioning device 30 while being given a predetermined degree of tension and also through the supply device 43. In such a series of operation, the first stitch has been produced on the fabric.

As aforementioned, the drive roller 49 will function as a unidirectional clutch with respect to the cylinder 46. While the additional amount of the upper thread is being supplied along with ascent of the take-up lever 14, the drive roller 49 is caused to rotate in a counter-clockwise direction (FIG. 2 and FIG. 5) so that the spherical balls 50 are loosely accomodated in the groove 49*a*. Thus, the drive roller 49 runs idle or races irrespective of the cylinder 46 which is not driven at this time. The additional amount of the upper thread may therefore be smoothly supplied without any resistance. The additional amount or shortage of the upper thread is detected by the rotation sensor 53 and stored in the memory 80.

The fabric on which the first stitch has been produced is then fed by the stepping motor 4 by an amount determined by the fabric feed control data for the second stitch, said data included in the stitch control data of the selected pattern. The fabric feed control data for the second stitch has been read out from the pattern data memory 67 while the practical amount of the upper thread 33 is reeled out of the bobbin 16. The needle amplitude for the second stitch has also been determined in dependence upon the needle amplitude control data therefor so that the stepping motor 4 causes the needle 17 to move to the second needle dropping point. Then, the theoretical upper thread supplying amount for producing the second stitch is calculated in the same manner as for the first stitch. Next, the predetermined shortage of the upper thread stored in the memory 80 is amended by a specific proportion to obtain a specific shortage, which will be valid for the succeeding stitches. The practical upper thread supplying amount is determined by deducting the specific shortage from the theoretical upper thread supplying amount. Thereafter, similar to the first stitch producing operation, the upper thread is released from engagement with the tensioning device 30 and then drawn out of the bobbin 16 by the practical amount by the drive roller 49, and the additional amount is supplied by means of the take-up lever 15 after the tensioning device 30 has been again actuated. The shortage amount which has been stored in the memory 80 when producing the first stitch will now be replaced by another shortage amount, which is a difference between the practically supplying amount determined by deducting the stored shortage from the theoretical amount and the amount actually required for producing the second stitch.

The third and succeeding stitches will be produced substantially in the same manner as for the second stitch. When a difference between the practical supplying amount and the amount actually required for producing the stitch is varied from the shortage amount which has been stored in the memory 80 for the preceeding stitch and larger than a predetermined minimum amount, the preceding data is renewed by such a different amount.

Figure 10:
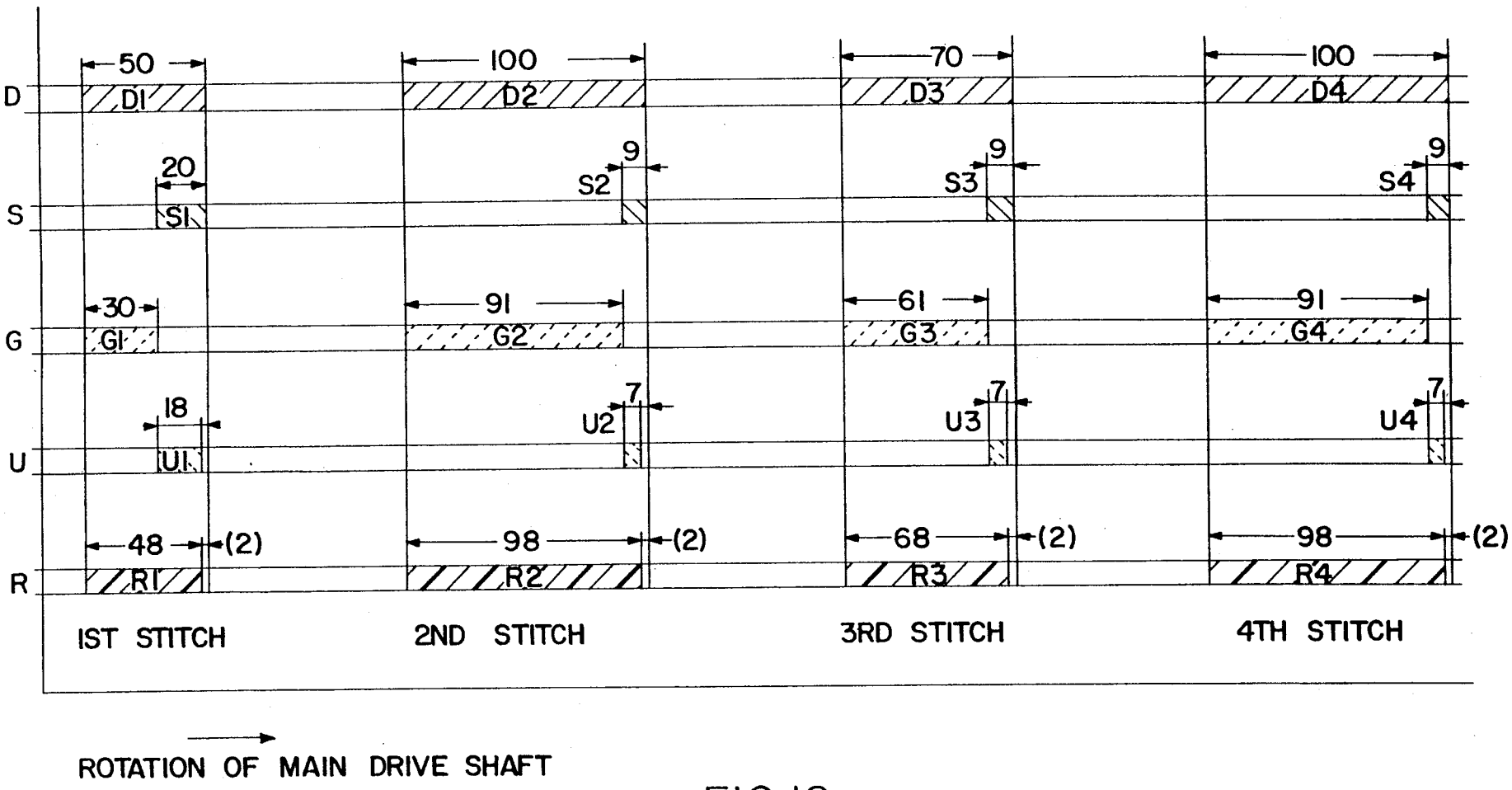
FIG. 10 is a graph showing relationship between various amounts of the upper thread.

The upper thread supplying procedure, especially relationship between the theoretical upper thread supplying amount and the practical upper thread supplying amount will be described by way of specific examples in reference to FIG. 10. In this figure, D represents the theoretical upper thread supplying amount, S the deducting amount, G the practical upper thread supplying amount, U the shortage and R the actual amount required for producing the stitch. A 1 mm length stitch will be formed by actuating the stepping motors with a control signal of 10 pulses. A theoretical amount for a first stitch $D_1$ of 5 mm length will be 50 1 pulses. A deduction amount $S_1$ which has been determined on an experimental basis will be 20 pulses for 2 mm shortage. A practical amount for the first stitch $G_1$ will be 30 pulses which can be considered enough to produce the 3 mm length stitch. Provided that 48 pulses ($R_1$) are required to actually produce the first stitch, there is a first shortage $U_1$ amounting to 18 pulses for an additional 1.8 mm length, which is drawn out of the bobbin while being given a predetermined tension. For a second stitch of 10 mm length, a second theoretical amount $D_2$ will be 100 pulses. A second deduction amount $S_2$ will be 9 pulses which is determined by multiplying the first shortage $U_1$ of 18 pulses by a predetermined specific proportion of ½. Thus, a second practical amount $S_2$ of 91 pulses is drawn out of the bobbin in the first step. If the same stitching conditions will be applied in formation of the second stitch, an actual thread supplying amount $R_2$ will be 100 pulses ($D_2$) minus 2 pulses (a difference between $D_1$ and $R_1$), that is 98 pulses. The resulting shortage $U_2$ is 7 pulses which is different from $U_1$ and larger than a predetermined minimum amount $U_0$ of 2 pulses, for example. The third and fourth stitches are produced in the same manners.

Figure 11:
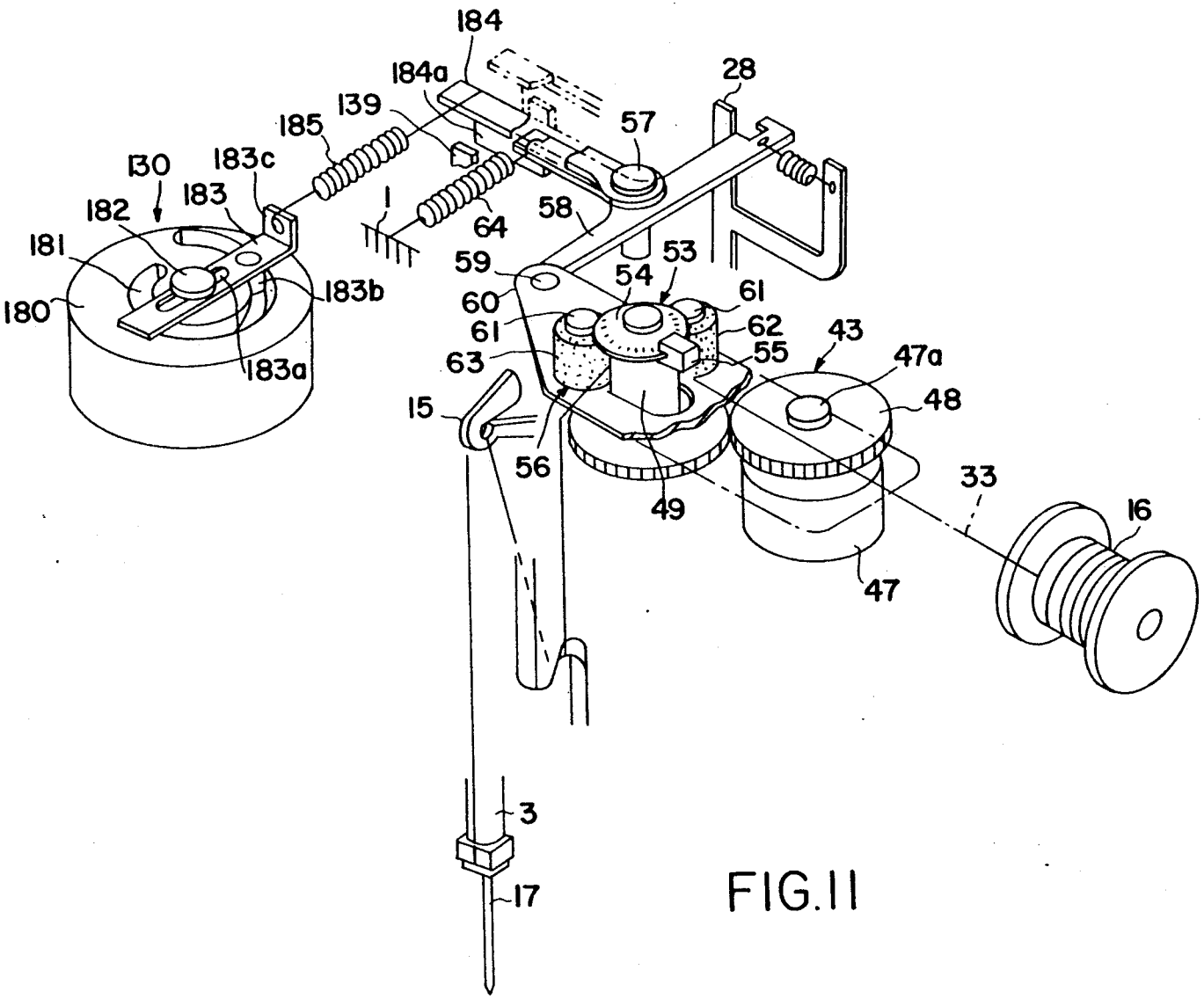
FIG. 11 is a perspective view showing another embodiment of the invention.

FIG. 11 illustrates another embodiment of the invention which includes an upper thread tensioning device having different arrangement and construction from that of the first embodiment. The bobbin 16, the upper thread supply device 43 and the one-way supply device 56 are identical to those in the first embodiment and detailed description thereof will be omitted here. The upper thread tensioning device 130 shown in FIG. 11 includes a tension adjusting dial 180 rotatably supported around a stationary axis 182 secured to the machine housing 1. A cam groove 181 extends axially through the dial 180 for engaging a pin 183*b* projecting downwardly from a sliding plate 183. The plate 183 is provided with an elongated slot 183*a* through which it is radially slidably connected to the axis 182. A spring 185 is connected between a standing end 183*c* of the plate 183 and a free end of a push lever 184 which is in turn rotatable about the rotational shaft 57 planted on the machine housing 1. As having been described in conjunction with the first embodiment, the lever 58 for releasably actuating the additional upper thread supplying device 56 is also rotatable about the shaft 57. The push lever 184 is provided with a downward projection 184*a* which will, by means of the spring 185, usually be in contact with the lever 58 to bias the latter to rotate in a counter-clockwise direction. More particularly, counter-clockwise rotation of the lever 58 will be first achieved by the spring 64 and further promoted by the push lever 184 biased by the spring 185. A release lever 139 is equivalent to the release lever 39 (FIG. 2) in the first embodiment, which is displaced in dependence upon rotation of the main drive shaft between a standby position shown by solid lines and an operative position shown by imaginary lines in which the push lever 184 is retracted away from the lever 58.

Operation of this embodiment will now be described. After the theoretical upper thread amount has been drawn out of the bobbin 16, the release lever 139 which has been located in the operative position shown by imaginary lines will now be returned to the standby position, away from the push lever 184, whereby the push lever 184 will be rotated in a counter-clockwise direction due to the biasing force of the spring 185, thereby enhancing counter-clockwise rotation of the lever 58. By this, the driven rollers 62 and 63 are brought into contact with the drive roller 49 with an increased degree of pressure. While a shortage of the upper thread is being drawn out of the bobbin 16 during ascent of the take-up lever 15, a predetermined tension may be applied to the upper thread 33 travelling between the drive roller 49, which runs idle with respect to the cylinder 46, and the driven rollers 62 and 63. The tension to be applied to the upper thread may be manually adjusted by rotation the dial 180 to change the biasing force of the spring 185 to be applied to the push lever 184. A reference mark (not shown) is provided on the machine housing 1 for easy adjustment of the upper thread tension.

Figure 12:
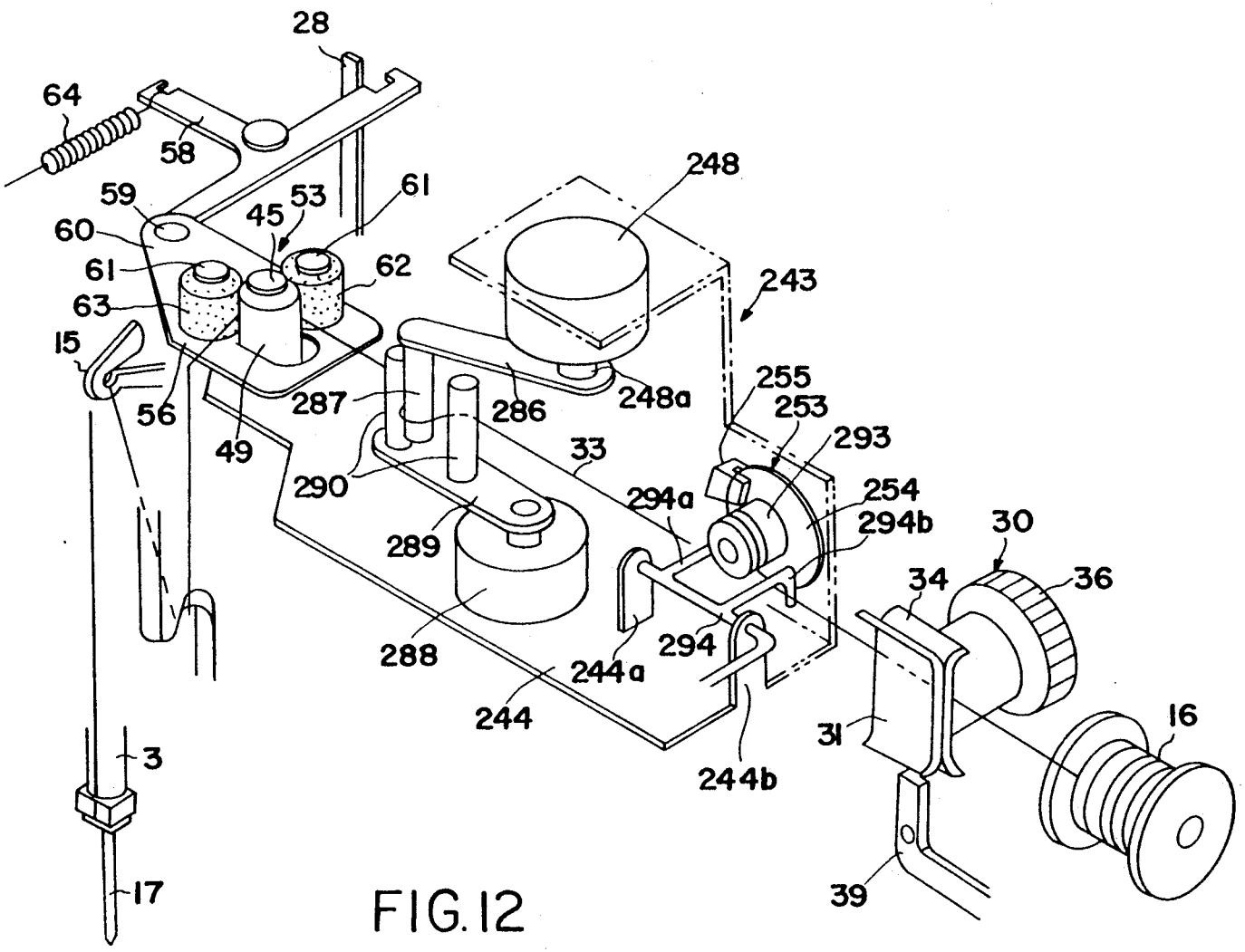
FIG. 12 is a perspective view showing still another embodiment of the invention.

FIG. 12 illustrates another embodiment which is modified from the first embodiment with respect to the upper thread supply device and the rotating amount detecting device. The same or similar members are accompanied by the identical numerals and detailed description therefor is omitted here. An upper thread supply device 243 employed in this embodiment includes a first stepping motor 248 mounted on a base 244 secured to the machine housing. To an output shaft 248*a* of the stepping motor 247 is secured an arm 286 provided at the other end with a downward projecting pin 287. Another stepping motor 288 is mounted on the base 244 and an adjusting plate 289 is secured to an output shaft thereof 288*a*. A pair of upward projecting pins 290 are mounted on the adjusting plate 289 to stand in opposition to the downward projecting pin 287. A rotating amount detecting device 253 Is in this embodiment disposed between the tensioning device 30 and the primary supply device 24. The detecting device 253 comprises a rotary disc 254 having a plurality of radially extending slits (not shown) and a known photo-interrupter 255. The disc 254 is secured to a cylinder 293 which is rotatable around a pin (not shown) fixed to the base 244 but prevented from axial displacement. An engaging member 294 is rotatably supported between a pair of upstanding walls 244*a* and 244*b* of the base 244. There is provided a spring (not shown) for biasing the engaging member 294 to rotate in a clockwise direction. A pair of arms 294*a* and 294*b* of the engaging member 294 extends laterally toward the cylinder 293. The upper thread 33 is guided beneath the arms 294*a* and 294*b* and around the cylinder 293.

With such arrangement, the theoretical upper thread amount is supplied from the bobbin 16 by means of the supply device 243, while no tension is applied thereto because the tensioning device 30 is not operative at this time. The stepping motor 248 is driven under control to rotate the arm 286 in a counter-clockwise direction. The downward projecting pin 287 will thus enter between the upward projecting pin 290 to pull the upper thread 33 out of the bobbin 16. Since the drive roller 49 is designed as an one-way clutch and the driven rollers 62 and 63 are in contact with the drive roller 49 under presser, the upper thread will not be drawn from the needle side. After the upper thread 33 has been supplied by the theoretical amount, the stepping motor 274 is driven in the opposite direction to retract the pin 287 away from the travelling path of the upper thread 33, and an additional amount or a shortage is supplied through the one-way supply device 56, during which a predetermined tension is given thereto by means of the tensioning device 30 in a manner described in connection with the first embodiment. When the upper thread 33 is additionally drawn out of the bobbin 16, the cylinder 293 is rotated in a counter-clockwise direction to detect the supplying amount by means of the sensor 253. The additionally supplying amount ma be adjusted by driving the second stepping motor 288 to rotate the adjusting plate 289 to thereby adjust relative position between the downward projecting pin 287 and the upward projecting pins 290.

Although the invention has been described in conjunction with specific embodiments thereof, it is to be understood that many variations and modifications may be made without departing from spirit and scope of the invention as defined in the appended claims.

What is claimed is:

1. An upper thread supplying device used in combination with a sewing machine having an upper thread supply source, a vertically reciprocating needle carrying an upper thread supplied from the upper thread supply source, loop taker means cooperating with the needle to form a stitch by interlocking the upper thread with a lower thread carried by the loop taker means and an upper thread take-up lever operated in synchronism with reciprocation of the needle, which comprises:

tension applying means for applying tension to the upper thread, said tension applying means being arranged between said upper thread supply source and said upper thread take-up lever and operated intermittently in synchronism with reciprocation of the needle;

upper thread supplying means for drawing the upper thread out of said upper thread supply source when said tension applying means is not operative;

operating means for determining a theoretical amount of the upper thread which is required for forming a desired stitch on a theoretical basis with stitch condition data inputted thereto, and also for determining a practical amount of the upper thread by deducting a specific amount from the theoretical amount, the practical amount of the upper thread being outputted therefrom; and control means operated in response to the output from said operating means for actuating said upper thread supplying means, thereby supplying the practical amount of the upper thread, said take-up lever pulling an additional amount of the upper thread, which is a difference between the practical amount supplied by said upper thread supply means and an amount actually required for completing the stitch, said additional amount being supplied from said upper thread supply source through said tension applying device which is now made operative to apply a predetermined tension to the upper thread, during ascent of said upper thread take-up lever.

2. The device according to claim 1 wherein said upper thread supplying means comprises a stepping motor driven under control by said control means, first roller means driven by said stepping motor and second roller means adapted to be in frictional contact with said first roller means to be rotated therewith, the upper thread travelling between said first and second roller means being supplied along with rotation of said first roller means.

3. The device according to claim 2 wherein said first roller means is designed as an one-way clutch for allowing the upper thread to be supplied from said upper thread supply source to said needle but preventing a reverse passage of the upper thread from the needle side.

4. The device according to claim 1 wherein said upper thread supplying means comprises a pair of first pins defining a travelling path of the upper thread, a second pin shiftable between a standby position in which it is located in opposition to said first pins and an operative position in which it enters between said first pins beyond the travelling path of the upper thread, a stepping motor driven under control by said control means to actuate said second pin and one-way supply means for allowing the upper thread to be supplied from said upper thread supply source but preventing a reverse passage of the upper thread from the needle side.

5. The device according to claim 1 which further comprises sensor means for detecting the additional amount of the upper thread, said additional amount being inputted to said operating means for newly determining a practical amount of the upper thread for the next stitch.

6. A process for supplying an upper thread from an upper thread bobbin to a vertically reciprocating needle in formation of a stitch with a sewing machine, comprising the steps of supplying a predetermined amount of the upper thread while applying no tension thereto, said predetermined amount being determined to be smaller than an amount considered to be theoretically required for producing a stitch; and then supplying an additional amount of the upper thread while applying a predetermined tension thereto, said additional amount being a difference between said predetermined amount and an amount actually required for producing the stitch, said upper thread supplying steps being controlled in synchronism with reciprocation of the needle.

* * * * *

UNITED STATES PATENT AND TRADEMARK OFFICE

CERTIFICATE OF CORRECTION

PATENT NO. : 5,022,335

DATED : June 11, 1991

INVENTOR(S) : Susumu HANYU, Noboru KASUGA, Mikio KOIKE, Kazumasa HARA, Mitsuru NISHIJIMA and Akiyoshi SASANO

It is certified that error appears in the above-identified patent and that said Letters Patent is hereby corrected as shown below:

Column 5, line 16, delete "45" and insert --46--;

line 20, delete "to".

Column 9, line 1, after "50" delete "1".

Column 10, line 44, delete "extends" and insert --extend--.

Column 11, line 3, delete "ma" and insert --may--.

Signed and Sealed this

Twenty-sixth Day of January, 1993

*Attest:*

STEPHEN G. KUNIN

*Attesting Officer*

*Acting Commissioner of Patents and Trademarks*